US011209742B1

(12) United States Patent
Minamoto

(10) Patent No.: US 11,209,742 B1
(45) Date of Patent: Dec. 28, 2021

(54) IMAGE CARRIER UNIT AND IMAGE FORMING APPARATUS INCLUDING THE SAME

(71) Applicant: KYOCERA Document Solutions Inc., Osaka (JP)

(72) Inventor: Riku Minamoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/368,513

(22) Filed: Jul. 6, 2021

(30) Foreign Application Priority Data

Jul. 10, 2020 (JP) ..... JP2020-119326

(51) Int. Cl.
*G03G 15/02* (2006.01)
*G03G 21/00* (2006.01)

(52) U.S. Cl.
CPC ..... *G03G 15/0225* (2013.01); *G03G 21/0058* (2013.01)

(58) Field of Classification Search
CPC ..... G03G 15/0216; G03G 15/0225
USPC ..... 399/100
See application file for complete search history.

(56) References Cited

U.S. PATENT DOCUMENTS

| | | | | |
|---|---|---|---|---|
| 9,915,888 | B2 * | 3/2018 | Morishita et al. | G03G 15/0225 |
| 9,939,751 | B2 * | 4/2018 | Tsuchiya et al. | G03G 15/0225 |
| 10,209,641 | B2 * | 2/2019 | Okura | G03G 15/0216 |
| 2015/0043940 | A1 | 2/2015 | Tsuji et al. | 399/100 |
| 2017/0139341 | A1 | 5/2017 | Morishita et al. | G03G 15/0258 |

FOREIGN PATENT DOCUMENTS

| | | | |
|---|---|---|---|
| JP | 2015-34905 | A | 2/2015 |
| JP | 2017-90740 | A | 5/2017 |

* cited by examiner

*Primary Examiner* — William J Royer
(74) *Attorney, Agent, or Firm* — Stein IP, LLC

(57) ABSTRACT

An image carrier unit includes an image carrier, a charging device including a charging member, a cleaning member, a pair of bearing members rotatably supporting the charging member and the cleaning member, a biasing member biasing the bearing members in an approaching direction to the image carrier, and a charging housing holding the charging member and the cleaning member, and a pair of separation members. The bearing members each include a first bearing portion supporting a first rotary shaft of the charging member, a second bearing portion supporting a second rotary shaft of the cleaning member, and an engaged portion. The first bearing portion has an elongated hole shape having a greater inner diameter in an approach/separation direction. The separation members are each inserted between the charging housing and the engaged portion, thus causing the bearing members to move in such a direction as to separate from the image carrier.

6 Claims, 10 Drawing Sheets

IMAGE CARRIER UNIT AND IMAGE FORMING APPARATUS INCLUDING THE SAME

INCORPORATION BY REFERENCE

This application is based upon and claims the benefit of priority from the corresponding Japanese Patent Application No. 2020-119326, filed on Jul. 10, 2020, the entire contents of which are incorporated herein by reference.

BACKGROUND

The present disclosure relates to an image carrier unit including an image carrier and a charging device having a charging member that charges the image carrier.

Conventionally, there is known an image carrier unit including a photosensitive drum (image carrier) on which an electrostatic latent image is formed and a charging device that charges the photosensitive drum. The charging device includes a charging roller (charging member) that contacts the photosensitive drum so as to charge the photosensitive drum, a cleaning roller (cleaning member) that contacts the charging roller so as to clean the charging roller, and a biasing member that biases the charging roller toward the photosensitive drum.

In the image carrier unit configured as above, the charging roller, when stored in contact with the photosensitive drum for an extended period of time, might be deformed with time. In such a case, a phenomenon (bleeding phenomenon) might also occur in which a rubber component of the charging roller adheres to a surface of the photosensitive drum. When this phenomenon occurs, it might no longer be possible for the image carrier to be charged uniformly by the charging member, resulting in the occurrence of an image failure.

In order, therefore, to suppress such deformation of the charging roller with time and the occurrence of the bleeding phenomenon, a technique has been proposed in which the charging roller is configured to be contactable/separable with/from the image carrier. For example, there is known an image forming unit including a charging member that charges an image carrier, a bearing member that supports the charging member so that the charging member is movable in such a direction as to contact/separate from the image carrier, a biasing member that biases the bearing member in such a direction that the charging member contacts the image carrier, and a separation member that holds the charging member in a separated state from the image carrier, and an image forming apparatus including the image forming unit.

Furthermore, in a case where a cleaning roller for cleaning the charging roller is provided, the cleaning roller is also in pressure contact with the charging roller. Hence, in order to prevent the charging roller from being deformed by being pressed, it is required to release both a nip between the photosensitive drum and the charging roller and a nip between the charging roller and the cleaning roller.

SUMMARY

An image carrier unit according to one aspect of the present disclosure includes an image carrier, a charging device, a pair of support frames, and a pair of separation members. The image carrier is rotatable, and an electrostatic latent image is formed thereon. The charging device includes a charging member that rotates following rotation of the image carrier, while being in contact with an outer peripheral surface of the image carrier, so as to charge the image carrier, a cleaning member that rotates in contact with an outer peripheral surface of the charging member so as to clean the charging member, a pair of bearing members that support both ends of each of the cleaning member and the charging member so that the cleaning member and the charging member are rotatable at a prescribed distance from each other, a biasing member that biases each of the pair of bearing members in an approaching direction to the image carrier, and a charging housing that holds the charging member and the cleaning member. The pair of support frames rotatably support the image carrier and hold the charging device. Each of the pair of bearing members includes a first bearing portion that rotatably supports a first rotary shaft of the charging member, a second bearing portion that rotatably supports a second rotary shaft of the cleaning member, and an engaged portion that protrudes from the charging housing to an opposite side to the image carrier, the pair of bearing members being reciprocatable in an approach/separation direction in which the pair of bearing members approach/separate from the image carrier. The first bearing portion has such an elongated hole shape that an inner diameter thereof in the approach/separation direction is greater than an inner diameter thereof in a direction orthogonal to the approach/separation direction. Each of the pair of separation members is inserted between the charging housing and the engaged portion through an opening formed in each of the pair of support frames, thus causing a corresponding one of the pair of bearing members to move in such a direction as to separate from the image carrier against a biasing force of the biasing member, so that the charging member separates from the image carrier. When the charging member is separated from the image carrier by the pair of separation members, the first rotary shaft of the charging member separates from an inner peripheral surface of the first bearing portion closer to the cleaning member, and thus the biasing force of the biasing member does not act between the charging member and the cleaning member. When the charging member is brought in pressure contact with the image carrier by removing the pair of separation members, the first rotary shaft of the charging member contacts the inner peripheral surface of the first bearing portion closer to the cleaning member, and thus the biasing force of the biasing member acts between the charging member and the cleaning member.

DETAILED DESCRIPTION

Figure 1:
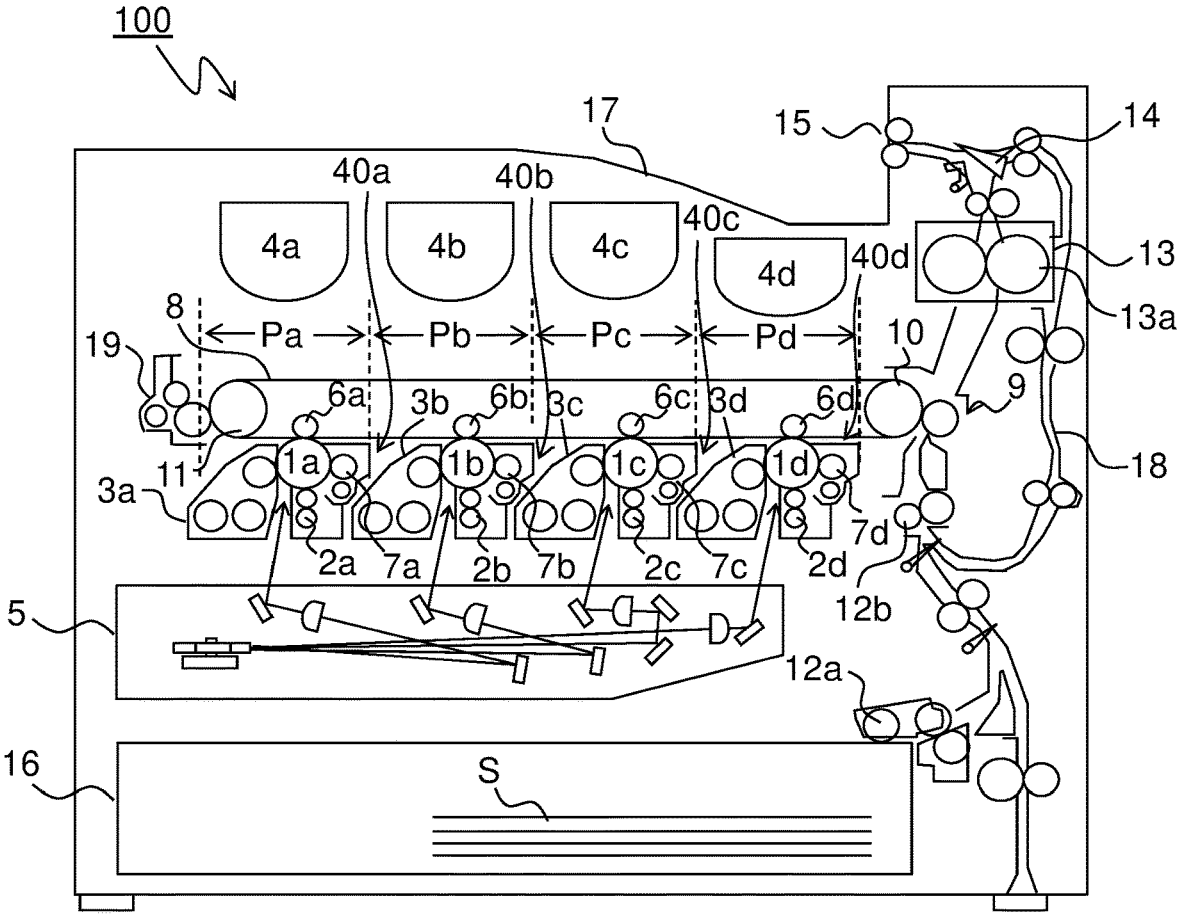
FIG. 1 is a schematic sectional view showing an interior configuration of an image forming apparatus in which a drum unit according to one embodiment of the present disclosure is mounted.

The following describes an embodiment of the present disclosure with reference to the appended drawings. FIG. 1 is a sectional view showing a schematic configuration of an image forming apparatus 100 in which drum units (image carrier units) 40*a* to 40*d* according to one embodiment of the present disclosure are mounted. In a main body of the image forming apparatus 100, four image forming portions Pa, Pb, Pc, and Pd are arranged in order from an upstream side (a left side in FIG. 1) in a conveyance direction. The image forming portions Pa to Pd are provided so as to correspond to images of four different colors (magenta, cyan, yellow, and black) and individually perform steps of charging, exposure, development, and transfer so as to sequentially form images of magenta, cyan, yellow, and black, respectively.

In the image forming portions Pa to Pd, photosensitive drums 1*a*, 1*b*, 1*c*, and 1*d* are arranged, respectively, to carry visible images (toner images) of the respective colors. An intermediate transfer belt 8 that rotates in a counterclockwise direction in FIG. 1 is also provided adjacently to the image forming portions Pa to Pd. Such toner images formed on the photosensitive drums 1*a* to 1*d* are sequentially transferred on the intermediate transfer belt 8 rotating in contact with the photosensitive drums 1*a* to 1*d*, and then in a secondary transfer roller 9, these toner images are collectively transferred on a sheet S as an example of a recording medium. The toner images are further fixed on the sheet S in a fixing portion 13, and then the sheet S is discharged from the main body of the image forming apparatus 100. While the photosensitive drums 1*a* to 1*d* are kept rotating in a clockwise direction in FIG. 1, an image forming process with respect to each of the photosensitive drums 1*a* to 1*d* is executed.

The sheet S on which toner images are to be transferred is contained in a sheet cassette 16 disposed in a lower part in the image forming apparatus 100 and is conveyed to the secondary transfer roller 9 via a paper feed roller 12*a* and a registration roller pair 12*b*.

Next, a description is given of an image forming procedure performed in the image forming apparatus 100. Upon a user's input to start image formation, first, the photosensitive drums 1*a* to 1*d* are started to rotate by a main motor (not shown), and a surface of each of the photosensitive drums 1*a* to 1*d* is charged uniformly by a charging roller 21 (see FIG. 2) of a corresponding one of charging devices 2*a* to 2*d*. Subsequently, the surface of each of the photosensitive drums 1*a* to 1*d* is irradiated with beam light (laser light) emitted from an exposure device 5 so that electrostatic latent images corresponding to an image signal are formed on the photosensitive drums 1*a* to 1*d*, respectively.

Each of developing devices 3*a* to 3*d* is filled with a prescribed amount of toner of a corresponding one of the respective colors of magenta, cyan, yellow, and black. In a case where a percentage of toner in a two-component developer filled in each of the developing devices 3*a* to 3*d* falls below a set value as a result of after-mentioned toner image formation, the developing devices 3*a* to 3*d* are replenished with fresh toner from toner containers 4*a* to 4*d*, respectively. The toner in the developer is supplied onto each of the photosensitive drums 1*a* to 1*d* by a developing roller 25 (see FIG. 2) of a corresponding one of the developing devices 3*a* to 3*d* and electrostatically adheres thereto. Thus, there are formed toner images corresponding to the electrostatic latent images formed by exposure from the exposure device 5.

Further, each of primary transfer rollers 6*a* to 6*d* applies an electric field at a prescribed transfer voltage between itself and a corresponding one of the photosensitive drums 1*a* to 1*d* so that the toner images of magenta, cyan, yellow, and black on the photosensitive drums 1*a* to 1*d* are primarily transferred on the intermediate transfer belt 8. These images of the four different colors are formed in a prescribed positional relationship preset for formation of a prescribed full-color image. After that, in preparation for subsequent formation of new electrostatic latent images, residual toner remaining on the surface of each of the photosensitive drums 1*a* to 1*d* is removed by a cleaning blade 28 (see FIG. 2) of a corresponding one of cleaning devices 7*a* to 7*d*.

When the intermediate transfer belt 8 starts to rotate in the counterclockwise direction as a drive roller 10 is driven to rotate by a belt drive motor (not shown), the sheet S is conveyed at prescribed timing from the registration roller pair 12*b* to the secondary transfer roller 9 provided adjacently to the intermediate transfer belt 8, where a full-color image is transferred on the sheet S. The sheet S on which the toner images have been transferred is conveyed to the fixing portion 13. Residual toner remaining on a surface of the intermediate transfer belt 8 is removed by a belt cleaning unit 19.

The toner images on the sheet S thus conveyed to the fixing portion 13 are heated and pressed by a fixing roller pair 13*a* so as to be fixed on a surface of the sheet S, and thus the prescribed full-color image is formed on the sheet S. A conveyance direction of the sheet S on which the full-color image has been formed is controlled by a branch portion 14 branching off in a plurality of directions, and thus the sheet S is directly (or after being conveyed to a double-sided conveyance path 18 and thus subjected to double-sided printing) discharged to a discharge tray 17 by a discharge roller pair 15.

Figure 2:
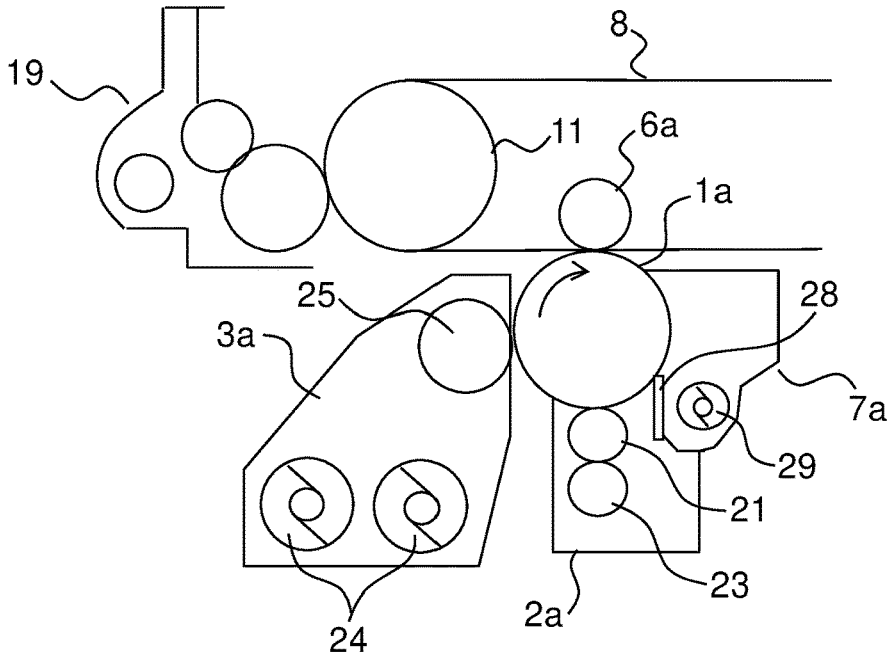
FIG. 2 is a partial enlarged view of a neighborhood of an image forming portion in FIG. 1.

Next, a description is given of the image forming portions Pa to Pd. FIG. 2 is a partial enlarged view of a neighborhood of the image forming portion Pa in FIG. 1. While the following describes the image forming portion Pa in detail, since the image forming portions Pb to Pd are also basically similar in configuration to the image forming portion Pa, duplicate descriptions thereof are omitted. As shown in FIG. 2, around the photosensitive drum 1*a*, the charging device 2*a*, the developing device 3*a*, and the cleaning device 7*a* are arranged along a drum rotation direction (a clockwise direction in FIG. 2), and the primary transfer roller 6*a* is disposed opposite to the photosensitive drum 1*a* via the intermediate transfer belt 8. Furthermore, on an upstream side in a rotation direction of the intermediate transfer belt 8 relative to the photosensitive drum 1*a*, the belt cleaning unit 19 is disposed to be opposed to a tension roller 11 via the intermediate transfer belt 8.

Furthermore, the photosensitive drum 1*a*, the charging device 2*a*, and the cleaning device 7*a* are integrated into a unit. The unit composed of the photosensitive drum 1*a*, the charging device 2*a*, and the cleaning device 7*a* in the image forming portion Pa, a unit composed of the photosensitive drum 1*b*, the charging device 2*b*, and the cleaning device 7*b* in the image forming portion Pb, a unit composed of the photosensitive drum 1*c*, the charging device 2*c*, and the cleaning device 7*c* in the image forming portion Pc, and a unit composed of the photosensitive drum 1*d*, the charging device 2*d*, and the cleaning device 7*d* in the image forming portion Pd are hereinafter referred to as drum units 40*a* to 40*d*, respectively.

The charging device 2*a* includes the charging roller 21 that contacts the photosensitive drum 1*a* so as to apply a charging bias to a drum surface thereof and a cleaning brush (cleaning member) 23 for cleaning the charging roller 21. The developing device 3*a* includes two stirring conveyance members 24 that are a stirring conveyance screw and a supply conveyance screw and the developing roller 25. The developing device 3*a* causes toner carried on a surface of the developing roller 25 to fly to the surface of the photosensitive drum 1*a* so as to develop an electrostatic latent image into a toner image.

The cleaning device 7*a* includes the cleaning blade 28 and a collection spiral 29. As shown in FIG. 2, the cleaning blade 28 is secured in contact with a part of the surface of the photosensitive drum 1*a* on an upstream side in the rotation direction relative to a position of contact between the photosensitive drum 1*a* and the charging roller 21. The cleaning blade 28 is disposed so as to be in contact with the photosensitive drum 1*a* in a counter direction with respect to the rotation direction of the photosensitive drum 1*a*. Residual toner removed from the surface of the photosensitive drum 1*a* by the cleaning blade 28 is discharged out of the cleaning device 7*a* as the collection spiral 29 rotates.

Figure 3:
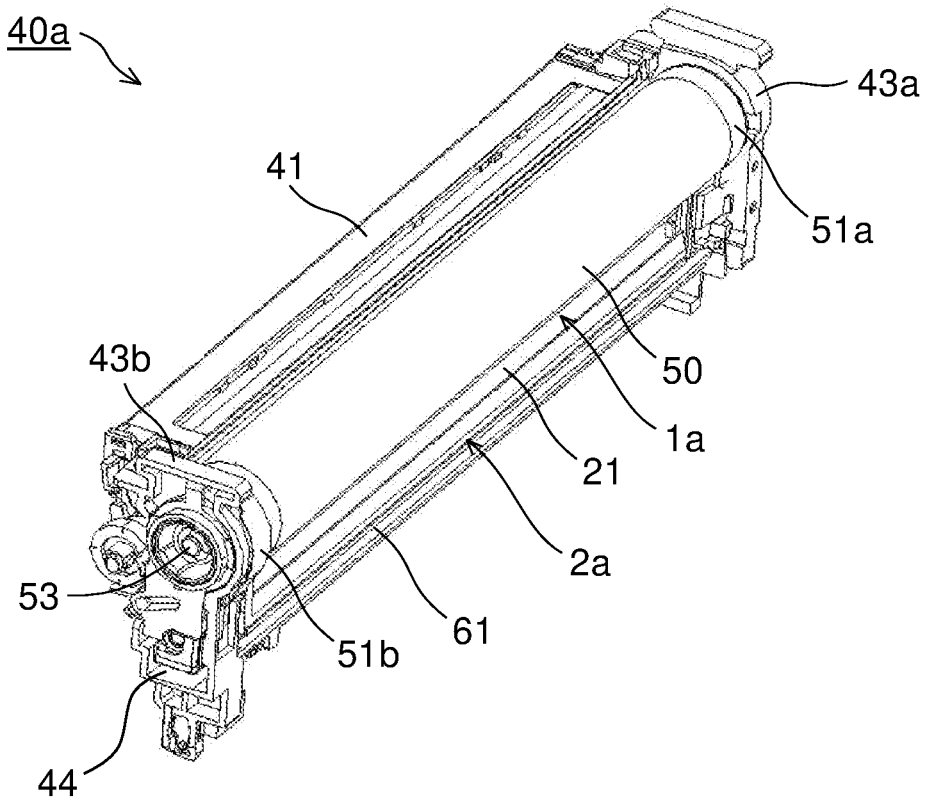
FIG. 3 is an outer appearance perspective view of the drum unit.
Figure 4:
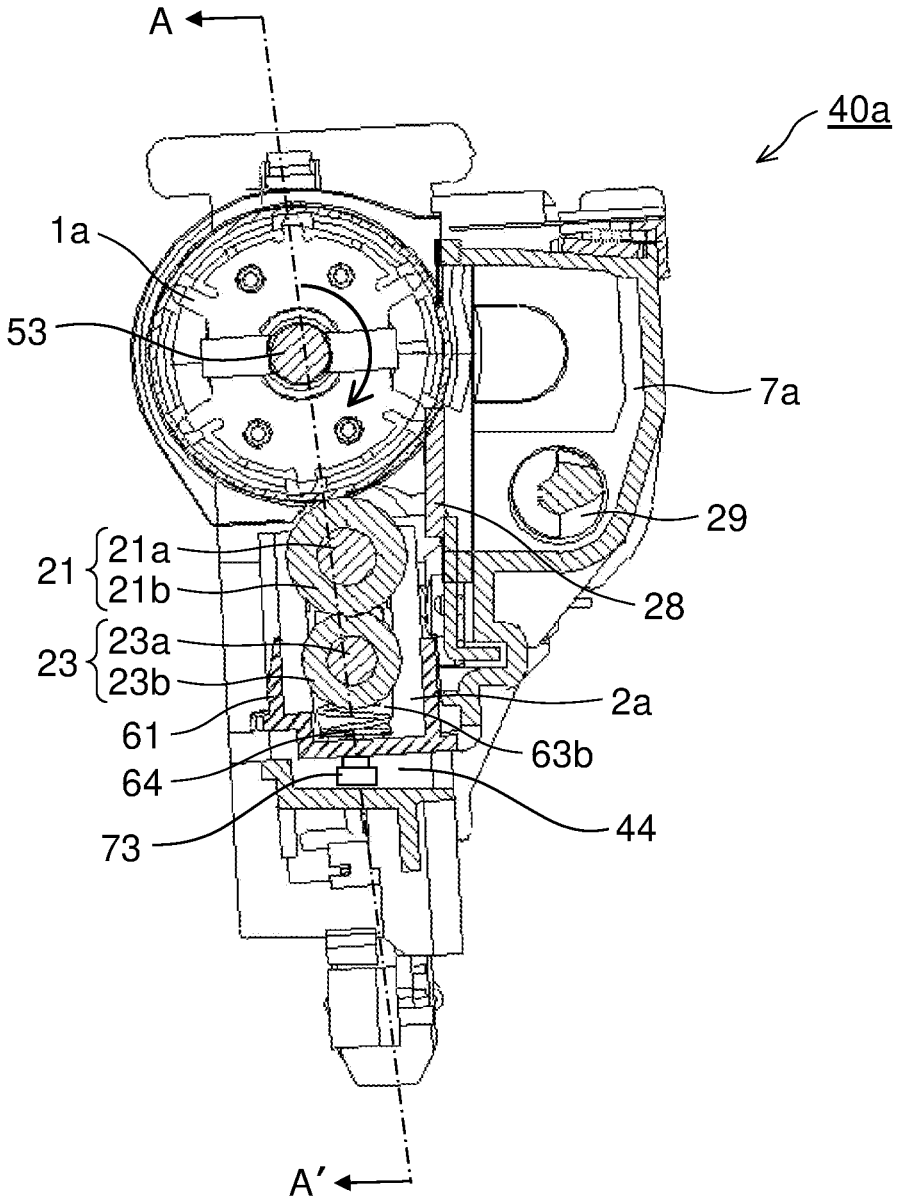
FIG. 4 is a side sectional view of the drum unit shown in FIG. 3.
Figure 5:
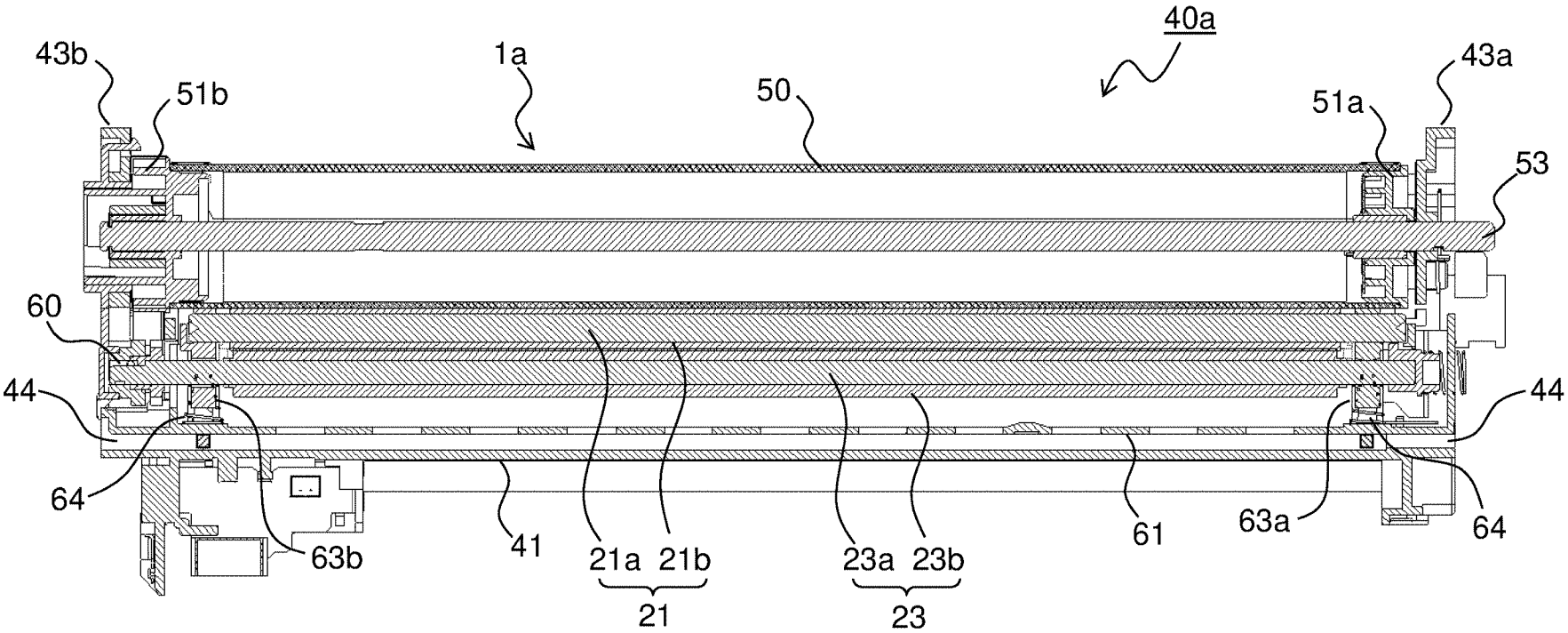
FIG. 5 is a longitudinal sectional view of the drum unit cut along an axial direction.

Next, a description is given of the drum unit 40*a* used in the above-described image forming apparatus 100. FIG. 3 and FIG. 4 are a perspective view and a side sectional view of the drum unit 40*a* in FIG. 2, respectively. FIG. 5 is a longitudinal sectional view (a sectional view taken in a direction of arrows A and A' in FIG. 4) of the drum unit 40*a* cut along an axial direction thereof. In FIG. 3, which shows a state as seen from a back side of FIG. 2, various members are disposed in a mirror-reversed manner from how they are disposed in FIG. 2. Furthermore, since the drum units 40*b* to 40*d* are also basically similar in configuration to the drum unit 40*a*, duplicate descriptions thereof are omitted.

As shown in FIG. 3 and FIG. 4, the drum unit 40*a* includes the photosensitive drum 1*a*, the charging device 2*a*, the cleaning device 7*a*, and a unit housing 41. A pair of support frames 43*a* and 43*b* that rotatably support both ends of the photosensitive drum 1*a* in an axial direction thereof are mounted to longitudinal both ends of the unit housing 41, respectively. Each of the support frames 43*a* and 43*b* has an opening 44 formed for inserting an after-mentioned separation member 80 (see FIG. 7) thereinto.

As shown in FIG. 5, the photosensitive drum 1*a* is composed of a cylindrical drum main body 50, flange portions 51*a* and 51*b* mounted respectively to both ends of the drum main body 50, and a drum rotary shaft 53 that penetrates through the drum main body 50 and is secured to respective centers of the flange portions 51*a* and 51*b*. The support frame 43*a* rotatably supports the drum rotary shaft 53 of the photosensitive drum 1*a*. The support frame 43*b* rotatably supports the flange portion 51*b* of the photosensitive drum 1*a*.

As shown in FIG. 4 and FIG. 5, the charging device 2*a* includes the charging roller 21, the cleaning brush 23, and a charging housing 61 that houses the charging roller 21 and the cleaning brush 23. The charging housing 61 is made of a resin having electrical non-conductivity and formed to extend in an axial direction of the charging roller 21. The charging roller 21 is an electrically conductive rubber roller formed of a metallic rotary shaft (first rotary shaft) 21*a* and an elastic layer 21*b* made of rubber and formed on an outer peripheral surface of the rotary shaft 21*a*. The charging roller 21 is brought in pressure contact with the photosensitive drum 1*a* under a prescribed nip pressure so as to rotate following rotation of the photosensitive drum 1*a*. The charging device 2*a* is mountable/demountable in/from the unit housing 41.

The cleaning brush 23 is formed of a rotary shaft (second rotary shaft) 23*a* and a brush portion 23*b* that is made of an electrically conductive resin such as nylon and protrudes on an outer peripheral surface of the rotary shaft 23*a*. The cleaning brush 23 rotates with the brush portion 23*b* in contact with an outer peripheral surface of the charging roller 21 so as to remove residual toner, paper dust, and so on adhering to the charging roller 21. A drive input gear 60 for transmitting a rotary drive force to the cleaning brush 23 is secured to an end of the rotary shaft 23*a* of the cleaning brush 23 near the flange portion 51*b*.

A pair of bearing members 63*a* and 63*b* that rotatably support the rotary shaft 21*a* of the charging roller 21 and the rotary shaft 23*a* of the cleaning brush 23 are disposed at both end sides of the charging roller 21 and the cleaning brush 23 in their axial directions, respectively. The bearing members 63*a* and 63*b* are made of an electrically conductive resin.

A compression coil spring (biasing member) 64 is disposed between the charging housing 61 and each of the bearing members 63*a* and 63*b*. An upper end of the compression coil spring 64 is in contact with a lower part of each of the bearing members 63*a* and 63*b*, and a lower end of the compression coil spring 64 is in contact with a bottom surface of the charging housing 61. The compression coil spring 64 biases the charging roller 21 toward the photosensitive drum 1*a* (upward) via the bearing members 63*a* and 63*b*. By this biasing force of the compression coil spring 64, the charging roller 21 is uniformly brought in pressure contact with the surface of the photosensitive drum 1*a* and thus rotates following rotation of the photosensitive drum 1*a*.

Figure 6:
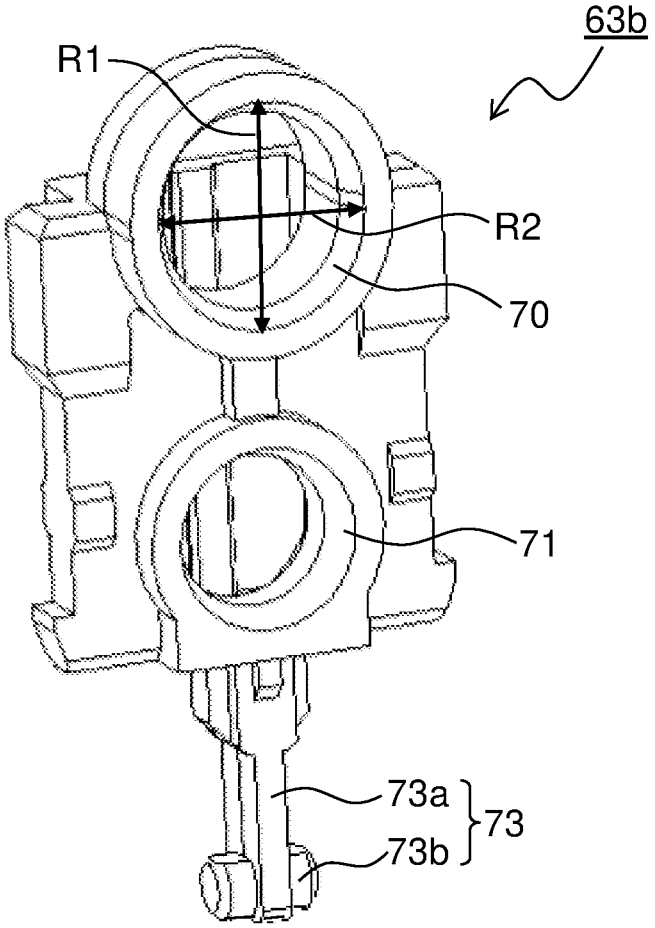
FIG. 6 is a perspective view of a bearing member as seen from inside.

FIG. 6 is a perspective view of the bearing member 63*b* as seen from inside. The bearing member 63*a* also has the same structure as that of the bearing member 63*b* except that it is bilaterally symmetrical to the bearing member 63*b*. As shown in FIG. 6, the bearing member 63*b* includes a first bearing portion 70 and a second bearing portion 71 formed integrally with each other. The first bearing portion 70 rotatably supports the rotary shaft 21*a* of the charging roller 21, and the second bearing portion 71 rotatably supports the rotary shaft 23*a* of the cleaning brush 23.

The first bearing portion 70 has such an elongated hole shape that an inner diameter R1 thereof in a contact/separation direction (an up-down direction in FIG. 6) in which the charging roller 21 contacts/separates from each of the photosensitive drums 1*a* to 1*d* is longer than an inner diameter R2 thereof in a direction (a left-right direction in FIG. 6) orthogonal to the contact/separation direction. The inner diameter R2 is substantially equal to an outer diameter of the rotary shaft 21*a*. Thus, the rotary shaft 21*a* is movable in the contact/separation direction within an area defined by the inner diameter R1. An inner diameter of the second bearing portion 71, on the other hand, is substantially equal to an outer diameter of the rotary shaft 23*a* of the cleaning brush 23.

Furthermore, formed in a lower part of the bearing member 63*b* is an engaged portion 73 with which engaging pieces 83*a* and 83*b* (see FIG. 7) of the separation member 80 are to engage. The engaged portion 73 includes a shaft 73*a* and a convex 73*b* that is formed at a lower end of the shaft 73*a* and has a diameter greater than that of the shaft 73*a*. As shown in FIG. 4 and FIG. 5, in a state where the bearing member 63*b* is incorporated in the drum unit 40*a*, the engaged portion 73 is disposed at a position overlapping the opening 44 as seen sideways.

Figure 7:
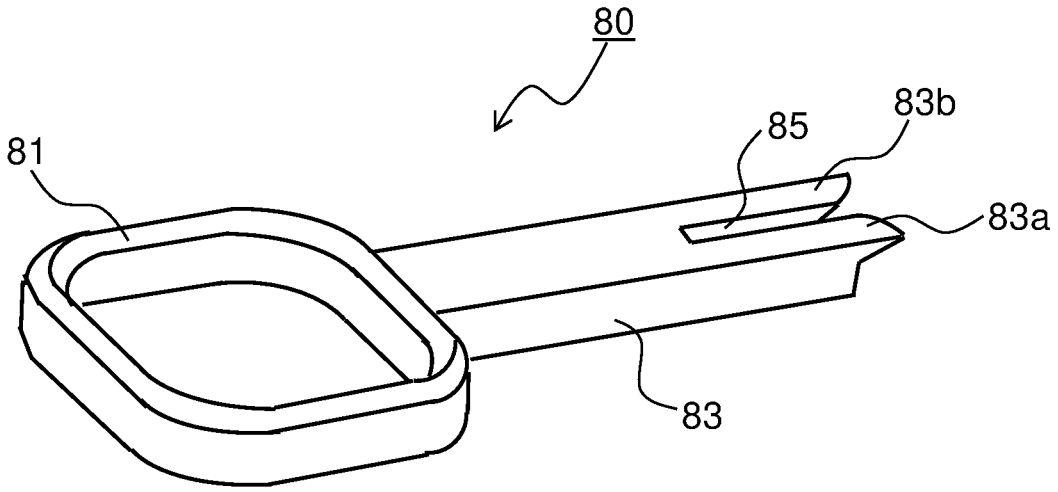
FIG. 7 is a perspective view of a separation member as seen from above.
Figure 8:
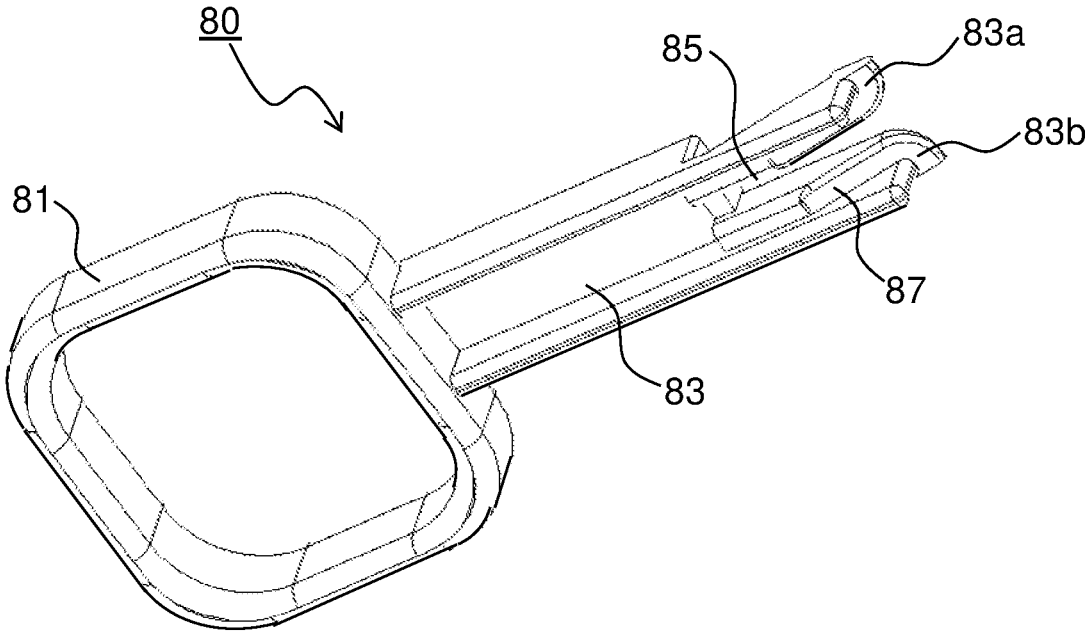
FIG. 8 is a perspective view of the separation member as seen from below.

FIG. 7 and FIG. 8 are perspective views of the separation member 80 as seen from above and below, respectively. The separation member 80 is integrally formed using resin and includes an annular grasping portion 81 and an insertion portion 83 protruding from an outer peripheral surface of the grasping portion 81. A distal end of the insertion portion 83 is longitudinally bifurcated by a perpendicular slit 85 into the engaging pieces 83*a* and 83*b* as a pair horizontally opposed to each other via the slit 85. The slit 85 has an opening width greater than an outer diameter of the shaft 73*a* of the engaged portion 73 and smaller than an outer diameter of the convex 73*b* of the engaged portion 73. The engaging pieces 83*a* and 83*b* have a wedge shape tapered toward distal ends thereof. On a back side of each of the engaging pieces 83*a* and 83*b*, an inclined surface 87 is formed that is inclined downward toward an upstream side (a lower left side in FIG. 8) in an insertion direction.

As described earlier, in a case where the charging roller 21 and each of the photosensitive drums 1*a* to 1*d* are stored in pressure contact with each other for an extended period of time, there might occur a trouble such as deformation of the charging roller 21 or bleeding of a rubber component thereof. As a solution to this, at a point in time before shipping of the drum units 40*a* to 40*d*, the separation member 80 is beforehand inserted into each of the drum units 40*a* to 40*b* so that the charging roller 21 separates from a corresponding one of the photosensitive drums 1*a* to 1*d*.

Figure 9:
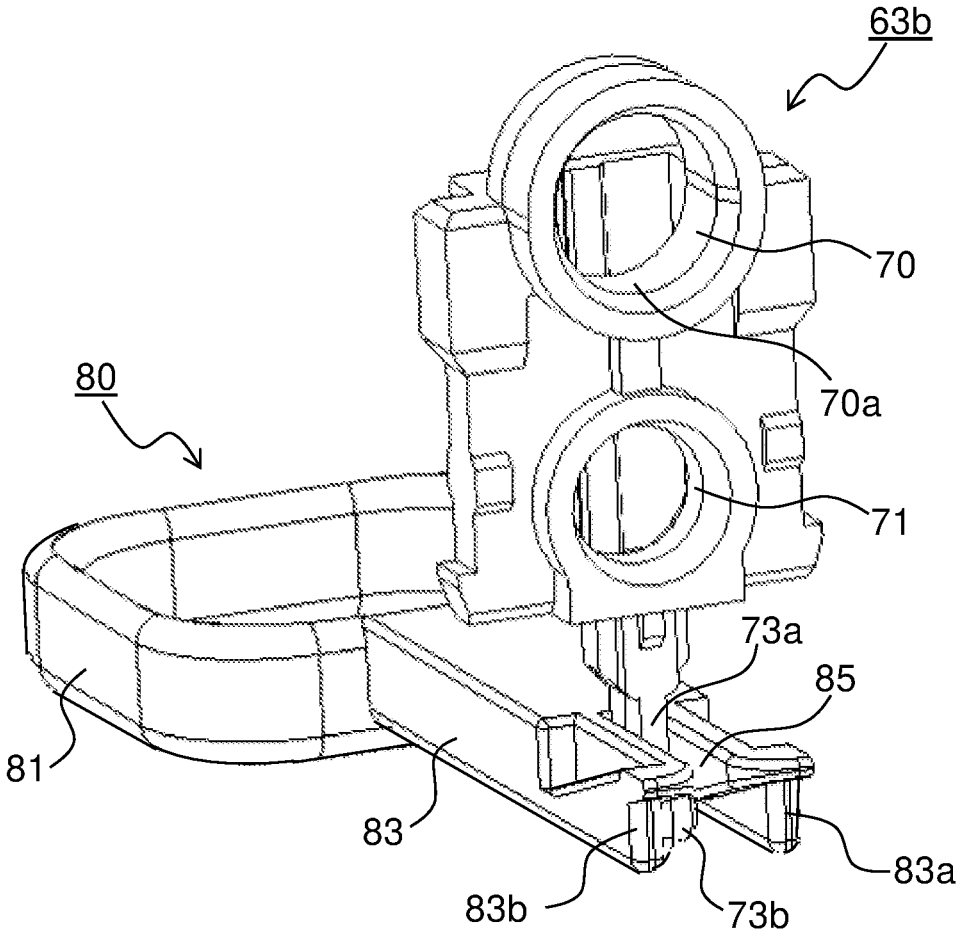
FIG. 9 is a perspective view showing a state where engaging pieces of the separation member have engaged with an engaged portion of the bearing member.

FIG. 9 is a perspective view showing a state where the engaging pieces 83*a* and 83*b* of the separation member 80 have engaged with the engaged portion 73 of the bearing member 63*b*. As the insertion portion 83 of the separation member 80 is inserted through the opening 44 of each of the support frames 43*a* and 43*b*, as shown in FIG. 9, the shaft 73*a* of the engaged portion 73 engages with the slit 85, and the distal ends of the engaging pieces 83*a* and 83*b* enter gaps between the charging housing 61 and the convex 73*b* of the engaged portion 73, respectively.

Figure 10:
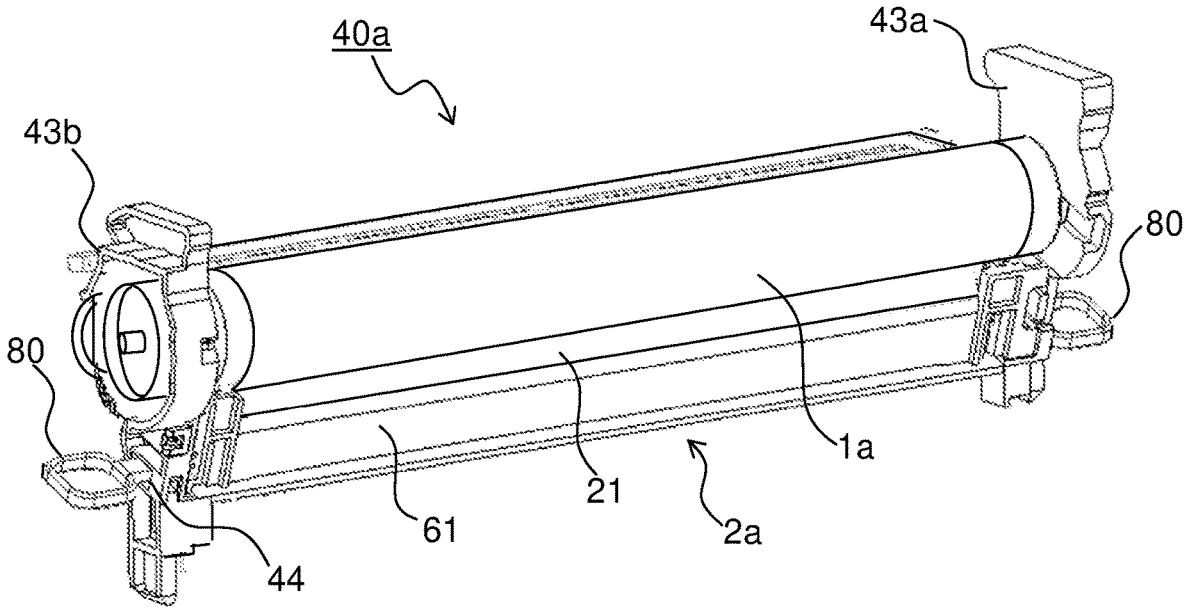
FIG. 10 is a perspective view of the drum unit into which the separation member has been inserted.
Figure 11:
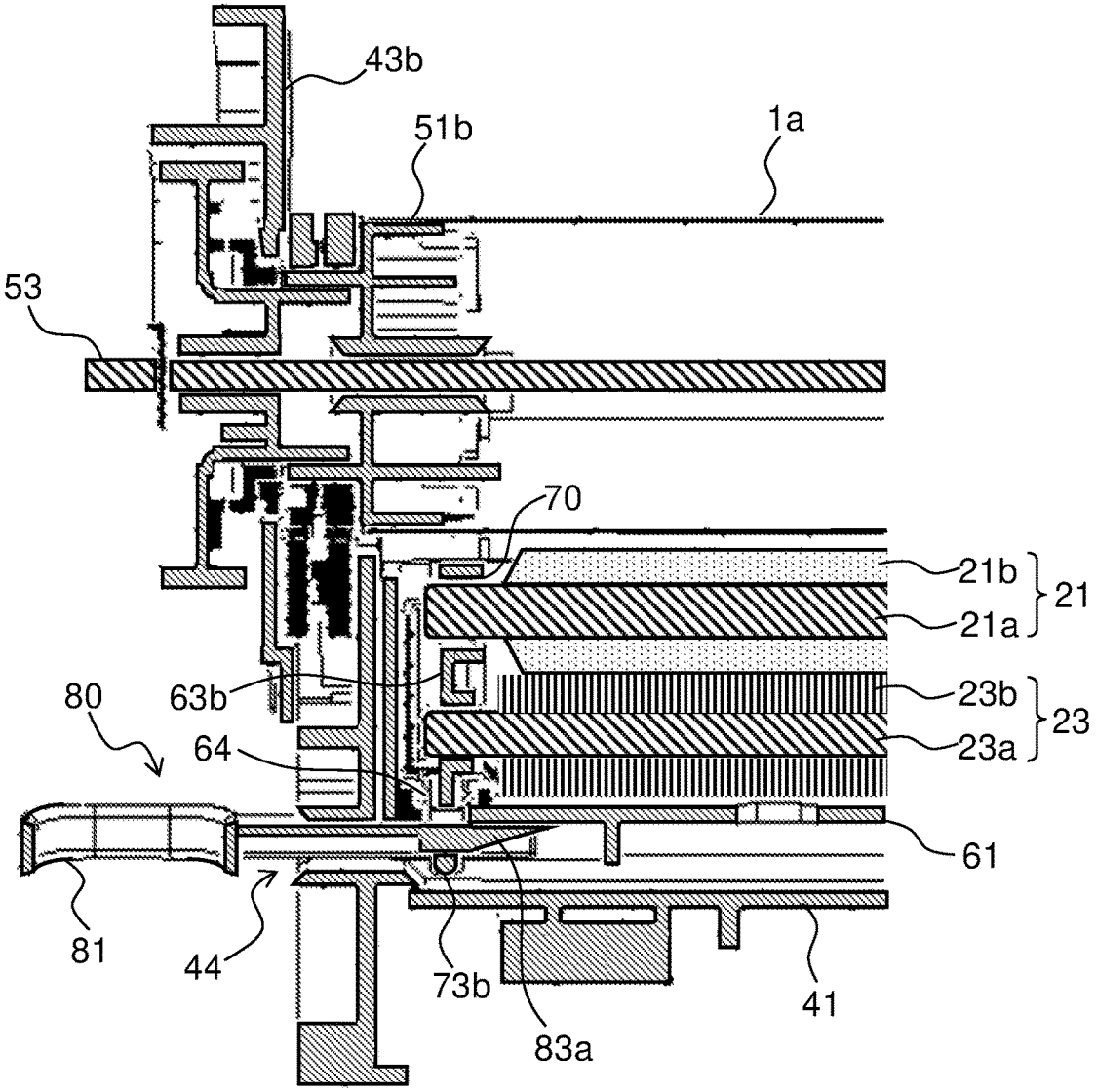
FIG. 11 is a partial sectional view, cut along the axial direction, of a vicinity of the bearing member of the drum unit into which the separation member has been inserted.

FIG. 10 is a perspective view of the drum unit 40*a* into which the separation member 80 has been inserted. FIG. 11 is a partial sectional view, cut along the axial direction, of a vicinity of the bearing member 63*b* of the drum unit 40*a* into which the separation member 80 has been inserted. When the separation member 80 is inserted further, the convex 73*b* of the engaged portion 73 rides on the inclined surface 87 formed on each of the engaging pieces 83*a* and 83*b*, and thus the bearing members 63*a* and 63*b* move downward. As a result, as shown in FIG. 11, the compression coil spring 64 is compressed, so that together with the bearing members 63*a* and 63*b*, the charging roller 21 also moves downward to separate from the photosensitive drum 1*a*.

By the above-described separation operation, the charging roller 21 is brought to a state free from a pressure from the photosensitive drum 1*a*, which is a reaction to (drag against) a pressing force exerted by the compression coil spring 64, namely, a pressing force in such a direction that the charging roller 21 separates from the photosensitive drum 1*a* in the contact/separation direction. At this time, the charging roller 21 is separated from an inner peripheral surface 70*a* (see FIG. 9) of the first bearing portion 70 on a lower side therein (near the cleaning brush 23) and is placed on a surface of the cleaning brush 23. That is, only a weight of the charging roller 21 acts on the cleaning brush 23, and a biasing force of the compression coil spring 64 does not act thereon.

Accordingly, the cleaning brush 23 and the charging roller 21 are not brought in pressure contact with each other, and thus it is possible to suppress deformation of the charging roller 21 caused by the cleaning brush 23 and collapsing of bristles of the cleaning brush 23.

Figure 12:
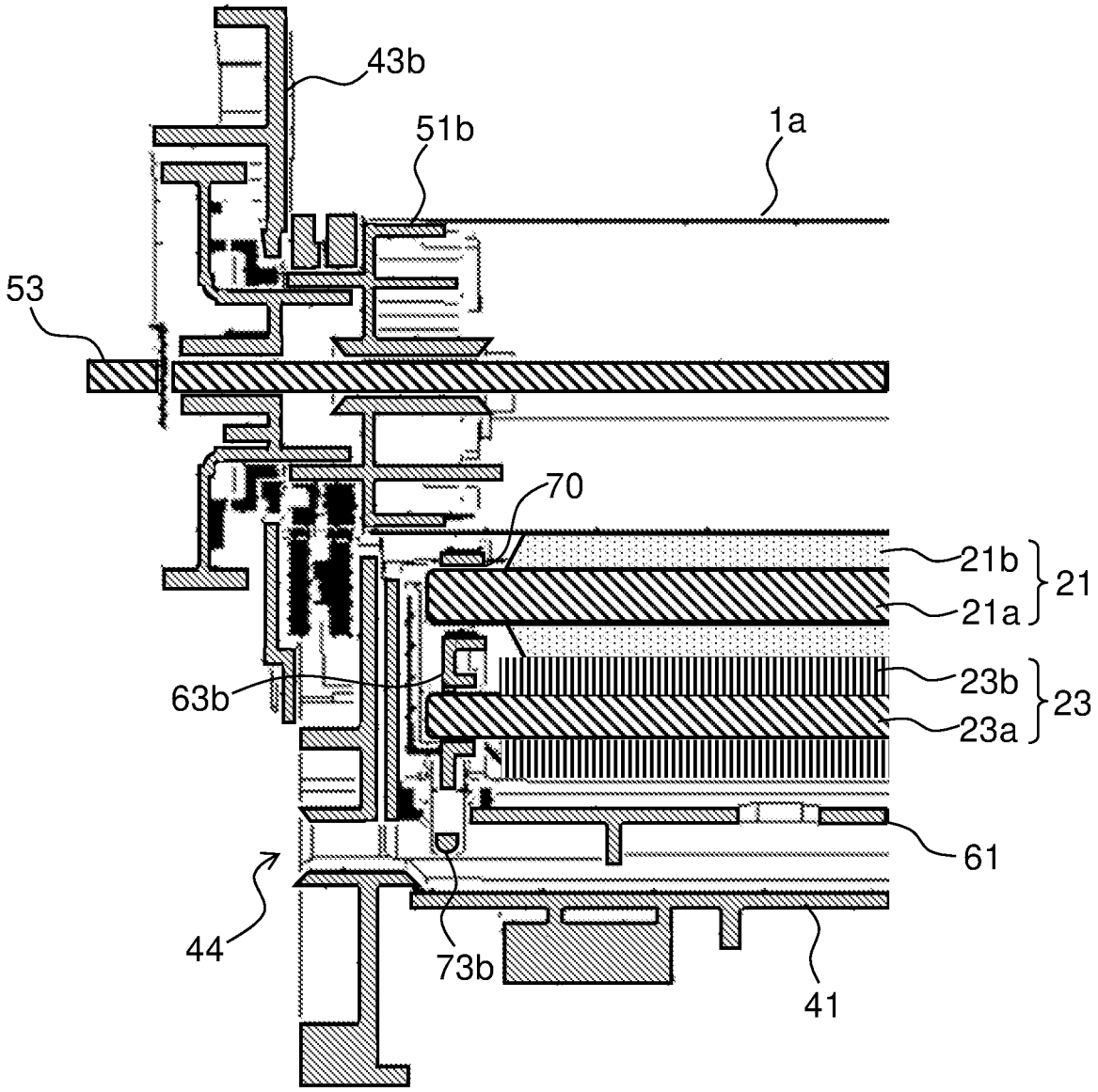
FIG. 12 is a partial sectional view showing a state where the separation member has been pulled out from a state shown in FIG. 11.

FIG. 12 is a partial sectional view showing a state where the separation member 80 has been pulled out from a state shown in FIG. 11. When the drum unit 40*a* is unpacked and put to actual use, the separation member 80 is pulled out from the state shown in FIG. 11 so that the engaging pieces 83*a* and 83*b* of the separation member 80 disengage from the engaged portion 73 of each of the bearing members 63*a* and 63*b*. Thus, the bearing members 63*a* and 63*b* move upward by a biasing force (resilience) of the compression coil spring 64. As a result, as shown in FIG. 11, together with the bearing members 63*a* and 63*b*, the charging roller 21 is brought in pressure contact with the photosensitive drum 1*a*.

By the above-described pressure contact operation, the charging roller 21 receives a pressure from the photosensitive drum 1*a*, which is a reaction to (drag against) a pressing force exerted by the compression coil spring 64, namely, a pressing force in such a direction that the charging roller 21 separates from the photosensitive drum 1*a* in the contact/separation direction. At this time, the charging roller 21 contacts the inner peripheral surface 70*a* of the first bearing portion 70 on the lower side therein, and a biasing force of the compression coil spring 64 acts on the charging roller 21, so that the cleaning brush 23 is brought in pressure contact with the charging roller 21.

According to the configuration of this embodiment, at the time of shipping of the drum units 40*a* to 40*d*, the separation member 80 is inserted into each of the drum units 40*a* to 40*d*, and thus each of the photosensitive drums 1*a* to 1*d* and the charging roller 21 are held in a separated state from each other. Furthermore, when the drum units 40*a* to 40*d* are put to use, the separation member 80 is pulled out from each of the drum units 40*a* to 40*d*, and thus each of the photosensitive drums 1*a* to 1*d* and the charging roller 21 are brought in pressure contact with each other.

As discussed above, each of the photosensitive drums 1*a* to 1*d* and the charging roller 21 can be made to separate from each other by an operation of inserting the separation member 80 into each of the drum units 40*a* to 40*d* and can be brought in pressure contact with each other by an operation of pulling out the separation member 80 from each of the drum units 40*a* to 40*d*. Accordingly, even in a case where the drum units 40*a* to 40*d* are stored for an extended period of time, it is possible to achieve improved workability in replacing the drum units 40*a* to 40*d* while suppressing deformation of the charging roller 21 and the occurrence of the bleeding phenomenon.

Furthermore, the first bearing portion 70 of each of the bearing members 63*a* and 63*b*, which supports the rotary shaft 21*a* of the charging roller 21, has such an elongated hole shape that the inner diameter R1 thereof in the contact/separation direction is longer than the inner diameter R2 thereof in the direction orthogonal to the contact/separation direction. Thus, when the separation member 80 is inserted, the charging roller 21 is brought to a state free from a pressing force in such a direction that the charging roller 21 separates from the photosensitive drum 1*a*, thus being positioned on an upper side in the first bearing portion 70 and placed on the surface of the cleaning brush 23. Accordingly, it is possible to suppress deformation of the charging roller 21 due to a pressing force from the cleaning brush 23 and collapsing of the bristles of the cleaning brush 23.

Furthermore, as shown in FIG. 10, in a state of being inserted into the opening 44 of each of the support frames 43*a* and 43*b*, the separation member 80 protrudes outward from each outer side surface of the drum unit 40*a*. With respect to the image forming apparatus 100, each of the drum units 40*a* to 40*d* is mounted perpendicularly from above and thus can hardly be mounted with the separation member 80 remaining inserted thereinto. This eliminates the possibility of inadvertently mounting each of the drum units 40*a* to 40*d* without pulling out the separation member 80 therefrom.

Other than the above, the present disclosure is not limited to the foregoing embodiment and can be variously modified without departing from the spirit of the disclosure. For example, while in the foregoing embodiment, the cleaning brush 23 is used as the cleaning member for cleaning the charging roller 21, a cleaning roller made of sponge-like rubber or resin may be used in place of the cleaning brush 23.

Furthermore, while the foregoing embodiment has shown an example in which the present disclosure is applied to a drum unit that is mounted in a color printer, the present disclosure is not limited thereto. The present disclosure is applicable, in an exactly similar manner, also to a drum unit that is mounted in a monochrome printer, a color copy machine, a monochrome copy machine, a digital multifunctional peripheral, a facsimile, or the like.

The present disclosure is usable in an image carrier unit provided with a charging device including a charging member and a cleaning member. Through the use of the present disclosure, it is possible to provide an image carrier unit and an image forming apparatus including the same. The image carrier unit uses a simple configuration to suppress deformation of the charging member and is capable of stably holding the charging member.

What is claimed is:

1. An image carrier unit, comprising:

an image carrier that is rotatable and on which an electrostatic latent image is formed;

a charging device including:

a charging member that rotates following rotation of the image carrier, while being in contact with an outer peripheral surface of the image carrier, so as to charge the image carrier;

a cleaning member that rotates in contact with an outer peripheral surface of the charging member so as to clean the charging member;

a pair of bearing members that support both ends of each of the cleaning member and the charging member so that the cleaning member and the charging member are rotatable at a prescribed distance from each other;

a biasing member that biases each of the pair of bearing members in an approaching direction to the image carrier; and a charging housing that holds the charging member and the cleaning member; and a pair of support frames that rotatably support the image carrier and hold the charging device, wherein each of the pair of bearing members includes:

a first bearing portion that rotatably supports a first rotary shaft of the charging member;

a second bearing portion that rotatably supports a second rotary shaft of the cleaning member; and an engaged portion that protrudes from the charging housing to an opposite side to the image carrier, the pair of bearing members being reciprocatable in an approach/separation direction in which the pair of bearing members approach/separate from the image carrier, the first bearing portion has such an elongated hole shape that an inner diameter thereof in the approach/separation direction is greater than an inner diameter thereof in a direction orthogonal to the approach/separation direction, the image carrier unit further comprises a pair of separation members that are each inserted between the charging housing and the engaged portion through an opening formed in each of the pair of support frames, thus causing a corresponding one of the pair of bearing members to move in such a direction as to separate from the image carrier against a biasing force of the biasing member, so that the charging member separates from the image carrier, when the charging member is separated from the image carrier by the pair of separation members, the first rotary shaft of the charging member is separated from an inner peripheral surface of the first bearing portion closer to the cleaning member, and thus the biasing force of the biasing member does not act between the charging member and the cleaning member, and when the charging member is brought in pressure contact with the image carrier by removing the pair of separation members, the first rotary shaft of the charging member contacts the inner peripheral surface of the first bearing portion closer to the cleaning member, and thus the biasing force of the biasing member acts between the charging member and the cleaning member.

2. The image carrier unit according to claim 1, wherein each of the pair of separation members includes:

an annular grasping portion; and an insertion portion that protrudes from an outer peripheral surface of the grasping portion, and a perpendicular slit with which the engaged portion is to engage is formed at a distal end of the insertion portion.

3. The image carrier unit according to claim 2, wherein the engaged portion includes:

a shaft that has a diameter smaller than an opening width of the slit; and a convex that is formed at a distal end of the shaft and has a diameter greater than a diameter of the shaft, and the slit has a horizontal opening width greater than an outer diameter of the shaft and smaller than an outer diameter of the convex.

4. The image carrier unit according to claim 2, wherein the insertion portion is longitudinally bifurcated by the slit and includes:

a pair of wedge-shaped engaging pieces that are horizontally opposed to each other via the slit and are tapered toward distal ends thereof; and an inclined surface that is formed on a lower surface of each of the pair of engaging pieces and is inclined downward from a downstream side toward an upstream side in an insertion direction.

5. An image forming apparatus comprising the image carrier unit according to claim 1 mounted therein.

6. The image forming apparatus according to claim 5, wherein the image carrier unit is mounted perpendicularly from above, and in a state of being inserted through the opening, each of the pair of separation members protrudes outward from an outer side surface of a corresponding one of the pair of support frames.

* * * * *